US007182444B2

(12) United States Patent
Kawamoto

(10) Patent No.: US 7,182,444 B2
(45) Date of Patent: Feb. 27, 2007

(54) INK JET RECORDING APPARATUS

(75) Inventor: Chiaki Kawamoto, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 254 days.

(21) Appl. No.: 10/926,045

(22) Filed: Aug. 26, 2004

(65) Prior Publication Data

US 2005/0046682 A1 Mar. 3, 2005

(30) Foreign Application Priority Data

Aug. 27, 2003 (JP) ..... 2003-302670

(51) Int. Cl.
*B41J 2/175* (2006.01)
*B41J 2/18* (2006.01)

(52) U.S. Cl. ..... 347/85; 347/89

(58) Field of Classification Search ..... 347/7, 347/84, 85, 92, 93, 89; 137/207.5, 565.01; 210/258

See application file for complete search history.

(56) References Cited

U.S. PATENT DOCUMENTS 4,149,172 A * 4/1979 Heinzl et al. ..... 347/92
4,175,489 A * 11/1979 Gattus ..... 101/366
5,296,875 A * 3/1994 Suda ..... 347/93
5,847,736 A * 12/1998 Kanbayashi et al. ..... 347/89
5,963,236 A * 10/1999 Miyashita et al. ..... 347/85
6,481,830 B2 * 11/2002 Naniwa et al. ..... 347/55
6,513,910 B2 * 2/2003 Naniwa et al. ..... 347/55
6,679,597 B2 1/2004 Ohsawa et al.
6,733,119 B2 5/2004 Naniwa et al.

FOREIGN PATENT DOCUMENTS

JP 2002-19148 A 1/2002
JP 2002-273867 A 9/2002

* cited by examiner

*Primary Examiner*—Anh T. N. Vo
(74) *Attorney, Agent, or Firm*—Sughrue Mion, PLLC

(57) ABSTRACT

The ink jet recording device includes an ink jet recording head and an ink circulation system. The ink circulation system has an ink tank, an ink feeding unit, an ink supplying system and an ink recovery system. The ink feeding unit is provided in the ink tank, and has both a function to supply ink from the ink tank to the recording head through the ink supplying system and a function to stir the ink stored in the ink tank. The ink circulation system circulates the ink by supplying the ink to the recording head through the ink supplying system and recovering the ink supplied to the recording head through the ink recovery system.

19 Claims, 5 Drawing Sheets

INK JET RECORDING APPARATUS

BACKGROUND OF THE INVENTION

The present invention relates to an ink jet recording apparatus, and more particularly to an ink jet recording apparatus which ejects ink from an ejection port of a recording head in accordance with an ejection signal to thereby perform a recording operation.

As well known, an ink jet recording system is widely used as a recording system for outputting color images, which is simple in construction and easy in reducing the apparatus size. In a recording apparatus (ink jet printer) based on the ink jet recording system, any of the following systems is usually employed: an electrostatic drive system, a thermal head system, and an electromechanical transducer (piezoelectric) system and others. A fluid material composed of at least colored particles dispersed in a solvent is generally used for a recording liquid (ink) used for recording in the ink jet printer. Recording (printing) is performed such that ink is ejected onto a recording material, such as recording paper, by using the recording system.

As for an ink tank storing the ink, the ink to be supplied to a recording head is not only stored in the ink tank, but also the ink must be constantly stirred in the ink tank so as to prevent colorant-containing particles dispersed in the stored ink from sedimenting in the ink tank and from losing uniformity of the particle dispersion.

With regard to this technique, JP 2002-19148 A discloses an ink jet recording apparatus whose ink tank includes an ink circulation system for stirring oil ink contained in the ink tank, and an ink supply system which is branched from the ink circulation system and supplies the ink to an ejection head, and in which stirring of the ink contained in the ink tank and supply of the ink to the ejection head are performed simultaneously by circulating the ink through the ink circulation system.

JP 2002-273867 A discloses an ink jet recording apparatus in which an ink tank is provided with ink stirring means separately from an ink circulation system in order to prevent ink particles from flocculating and/or sedimenting (more specifically, to prevent large-sized aggregates and/or sediments from being produced from the ink particles) during the circulation of ink in the ink tank.

However, the conventional ink jet recording apparatuses involve the following problems.

In the technique disclosed in JP 2002-19148 A, the ink circulation passage including a circulation pump of a high flow rate and the ink-supplying/recovering passage which is branched from the ink circulation passage are provided outside the ink tank. With provision of those passages, size of a part including the circulation passage is large, and its structure is complicated.

In the technique disclosed in JP 2002-273867 A, the ink stirring means is provided in the ink tank separately from the ink circulation system. Therefore, apparatus cost is increased and a large mounting space is required on the ink tank side.

SUMMARY OF THE INVENTION

The present invention has been accomplished under these circumstances, and an object of the invention is to solve the problems associated with the prior art and to provide an ink jet recording apparatus which is simple in construction and is capable of preventing ink particles from flocculating and sedimenting and maintaining dispersion of the ink particles in a consistent manner.

In order to attain the object described above, the invention provides an ink jet recording device, comprising an ink jet recording head and an ink circulation system which circulates ink by supplying the ink to the ink jet recording head and recovering the ink supplied to the recording head, wherein the ink circulation system comprises an ink tank which stores the ink, ink feeding means for supplying the ink to the ink jet recording head, an ink supplying system through which the ink is supplied from the ink tank to the ink jet recording head by the ink feeding means and an ink recovery system through which the ink is recovered from the ink jet recording head to the ink tank, and wherein the ink feeding means is provided in the ink tank, and has both a function to supply the ink from the ink tank to the ink jet recording head and a function to stir the ink stored in the ink tank.

Preferably, the ink is obtained by dispersing at least colored particles in a solvent.

Preferably, the ink feeding means comprises a no-sliding type pump having no sliding part and comprising at least one ink suction port immersed in the ink tank and at least two ink discharge ports immersed in the ink tank, and at least one ink discharge port of the at least two ink discharge ports communicates with the ink supplying system and at least one ink discharge port of the other is opening to the ink in the ink tank.

Preferably, the no-sliding type pump is a centrifugal pump.

Preferably, a filter is provided in the at least one ink suction port.

Preferably, the ink circulation system further comprises bubble removal means for removing one or more bubbles, provided in an ink passage connected to at least one ink discharge port of the at least two ink discharge ports.

Preferably, the ink circulation system further comprises ink physical property detecting means for detecting one or more physical properties of the ink, provided in an ink passage connected to at least one ink discharge port of the at least two ink discharge ports.

Preferably, the ink physical property detecting means is an ink concentration detector for detecting an ink concentration of the ink in the ink passage Preferably, the ink circulation system further comprises ink temperature regulating means for regulating ink temperature of the ink, provided in an ink passage connected to at least one ink discharge port of the at least two ink discharge ports.

Preferably, the ink circulation system further comprises bubble removal means for removing one or more bubbles, provided in an ink passage.

Preferably, the ink passage in which the bubble removal means is provided is the ink supplying system through which the ink is supplied from the ink tank to the ink jet recording head.

Preferably, the ink circulation system further comprises ink physical property detecting means for detecting one or more physical properties of the ink, provided in an ink passage.

Preferably, the ink circulation system further comprises ink temperature regulating means for regulating ink temperature of the ink.

Preferably, the ink temperature regulating means is provided in at least one of the ink jet recording head, the ink tank, the ink supplying system and the ink recovery system.

In the ink jet recording apparatus according to the invention, the ink supplying function and the ink stirring function are achieved by one pump and the pump is immersed in the ink tank. This makes it possible to provide an ink jet recording apparatus wherein the entire construction of the ink circulation system is simplified, ink particles are prevented from flocculating and sedimenting, and dispersion of the ink particles can be consistently maintained.

The ink jet recording apparatus according to the invention is simple in construction, prevents the aggregation and sedimentation of ink particles, and consistently maintains the dispersion of the ink particles. Therefore, the present invention has a marked effect that an ink jet recording apparatus capable of consistent recording can be provided.

Oil ink used in the electrostatic ink jet recording apparatus has colorant-containing particles dispersed in a non-aqueous solvent. The dispersion stability affects the dot diameter and image quality. However, according to the ink jet recording apparatus of the present invention, the dispersion stability is more enhanced.

Other and further objects, features and advantages of the invention will be explained more fully from the following description.

This application claims priority on Japanese patent application No. 2003-302670, the entire contents of which are hereby incorporated by reference.

DESCRIPTION OF THE PREFERRED EMBODIMENTS

The ink jet recording apparatus according to the present invention will now be described in detail based on preferred embodiments illustrated in the accompanying drawings.

Figure 6:
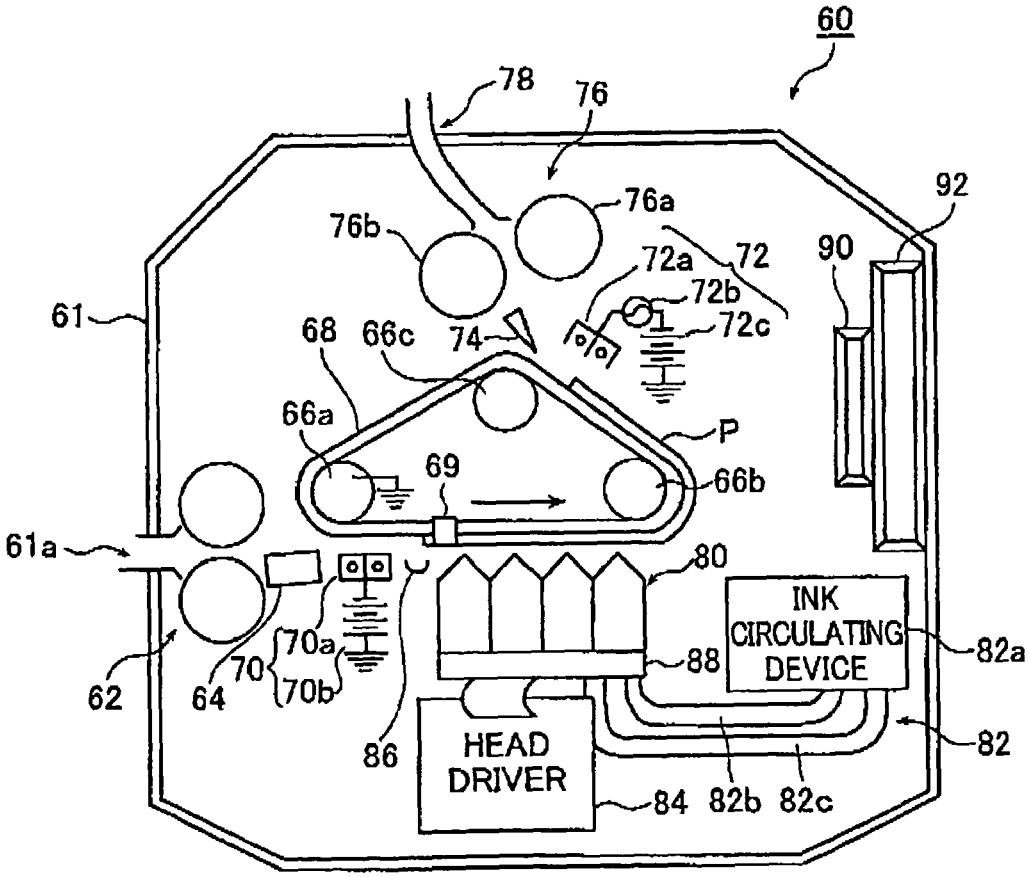
FIG. 6 is a schematic diagram showing an overall construction of an electrostatic ink jet printer according to an embodiment of the invention.

FIG. 6 is a schematic diagram showing an overall construction of an electrostatic ink jet printer according to an embodiment of the invention. In the ink jet printer according to the embodiment, ink droplets in four colors are ejected by means of image forming means onto a recording medium P being transported by transporting means, in accordance with input image data, thereby forming an image by ink particles on the recording medium P. The ink particle image formed on the recording medium P is fixed, and a full color image is thus formed on the recording medium P.

An ink jet printer 60 shown in FIG. 6 is an apparatus that performs one-sided four-color printing on the recording medium P. For this purpose, as the means for transporting the recording medium P, the ink jet printer 60 includes a feed roller pair 62, a guide 64, rollers 66*a*, 66*b*, and 66*c*, a transport belt 68, a transport belt position detection means 69, an electrostatic attraction means 70, a discharge means 72, a peeling means 74, a fixing/transporting means 76, and a guide 78. Also, as the image forming means, the ink jet printer 60 includes an recording head unit 80, an ink circulation system 82, a head driver 84, a recording medium position detection means 86, and a recording position control means 88. Further, the ink jet printer 60 includes a discharge fan 90 and a solvent collecting device 92 as the solvent collecting means. The ink jet printer 60 further includes an enclosure 61 for accommodating those components.

First, the transport means for the recording medium P in the ink jet printer 60 will be described.

The feed roller pair 62 is provided adjacent to an inlet 61*a* provided on a side surface of the enclosure 61 and is composed of a pair of rollers that feed the recording medium P from a not-shown tray to the transport belt 68 (portion supported by the roller 66*a*) provided in the enclosure 61. The guide 64 is provided between the feed roller pair 62 and the roller 66*a* supporting the transport belt 68, and guides the recording medium P to the transport belt 68.

Although not illustrated, it is preferable that a foreign matter removing means for removing foreign matter, such as dust or paper waste, adhering to the recording medium P is provided in proximity to the feed roller pair 62. As the foreign matter removing means, a means based on a known non-contact method, such as suction removal, blowing-off removal, or electrostatic removal, or a means based on a contact method using a brush, a roller, or the like may be used alone or in combination. Also, the feed roller pair 62 may be constructed using slightly adhesive rollers and a cleaner may be provided to the feed roller pair 62, which removes foreign matter, such as dust or paper waste, at the time of feeding of the recording medium P by the feed roller pair 62.

The rollers 66*a*, 66*b*, and 66*c* stretch and move the transport belt 68, and at least one of the rollers 66*a*, 66*b*, and 66*c* is connected to a not-shown drive source.

The transport belt 68 functions as a platen for holding the recording medium P and moves the recording medium P at the time of image formation by ink ejected from the recording head unit 80, and transports the recording medium P to the fixing/transporting means 76 after the image formation. Consequently, an endless belt made of a material that has superior dimensional stability and high durability is used as the transport belt 68. As the material thereof, a metal, a polyimide resin, a fluororesin, another resin, or a complex thereof is used, for instance.

In this embodiment, the recording medium P is held on the transport belt 68 through electrostatic attraction, so that a side (front surface) of the transport belt 68 holding the recording medium P is insulative and a side (back surface) of the transport belt 68 contacting the rollers 66*a*, 66*b*, and 66*c* is conductive. In more detail, the transport belt 68 is a belt produced by applying a fluororesin coat to the front surface of a metallic belt. Also, in the illustrated case, the roller 66*a* is a conductive roller and the back surface (metallic surface) of the transport belt 68 is grounded through the roller 66*a*.

It is preferable that meandering of the transport belt 68 is suppressed with a known method. For instance, the meandering of the transport belt 68 may be suppressed using a method with which tension at both ends in the widthwise direction of the transport belt 68 is changed by setting the roller 66*c* as a tension roller and tilting the axis of the roller 66*c* with respect to the axes of the roller 66*a* and the roller 66*b* in accordance with an output from the transport belt position detection means 69, that is, a detected position of the transport belt 68 in the widthwise direction. Alternatively, the meandering may be suppressed by forming the rollers 66*a*, 66*b*, and 66*c* in a tapered shape or a crown shape, for instance.

The electrostatic attraction means 70 charges the recording medium P to a predetermined potential, as a result of which the recording medium P is attracted to and held on the transport belt 68 by means of an electrostatic force and applied with a predetermined bias with respect to the recording head unit 80 for image formation.

In this embodiment, the electrostatic attraction means 70 includes a scorotron charger 70*a* for charging the recording medium P and a negative high voltage power supply 70*b* connected to the scorotron charger 70*a*. The recording medium P is charged to a negative high voltage by the scorotron charger 70*a* connected to the negative high voltage power supply 70*b* and is electrostatically attracted to the insulation layer of the transport belt 68.

After the recording medium P is electrostatically attracted to the transport belt 68 by means of an electrostatic force so that no floating of the recording medium P occurs, the electrostatic attraction means 70 uniformly charges a surface of the recording medium P transported by the transport belt 68. Here, it is sufficient that the transport speed of the transport belt 68 at the time of the charging of the recording medium P is in a range in which the charging is performed in a consistent manner, and it does not matter whether this transport speed is the same as or is different from a transport speed at the time of image recording. Also, by circulating the recording medium P multiple times, the electrostatic attraction means 70 may charge a single recording medium P multiple times and achieve uniform charge.

The recording medium P charged by the electrostatic attraction means 70 is transported to the position of the recording head unit 80 to be described later by the transport belt 68. In the image forming portion by the recording head unit 80, a recording signal voltage is applied to the recording head unit 80 by regarding the charge potential of the recording medium P as a bias. As a result, the recording signal voltage is superposed on the bias charged potential, and an ink droplet is ejected to form an image on the recording medium P. Here, by providing a means for heating the transport belt 68 and increasing the temperature of the recording medium P, fixation of the ink droplets ejected from the recording head unit 80 on the recording medium P may be accelerated. In this case, it becomes possible to further suppress blurring and improve image quality.

The recording medium P, on which an image has been formed, is discharged by the discharge means 72, is peeled off the transport belt 68 by the peeling means 74, and is transported to the fixing/transporting means 76.

In this embodiment, the discharge means 72 includes a corotron discharger 72*a*, an AC power supply 72*b* and a DC high voltage power supply 72*c*, with a terminal of the DC high voltage power supply 72*c* on one side being grounded. The discharge means 72 of the illustrated example uses a so-called AC corotron discharger that uses the corotron discharger 72*a* and the AC power supply 72*b*, although it is possible to use various other means and methods such as a scorotron discharger, a solid charger, and a discharge needle, for instance. In addition, a construction using a conductive roller or a conductive platen is suitably used like in the case of the electrostatic attraction means 70 described above.

Also, as the peeling means 74, it is possible to use various known techniques such as a peeling blade, a reverse rotation roller, and an air knife.

The recording medium P peeled off the transport belt 68 is sent to the fixing/transporting means 76, which then fixes the image formed by the ink. In this embodiment, as the fixing/transporting means 76, a roller pair composed of a heat roller 76*a* and a transport roller 76*b* is used. With this construction, during the transport of the recording medium P by the fixing/transporting means 76, fixing of the image formed on the recording medium P is achieved through contact heating. However, other fixing means provided separately from the transport means composed of the transport roller pair and other fixation methods may be used to perform fixation.

The heat roller is used for the heat fixing of the image in the above-mentioned embodiment. If required, any of other heat fixing techniques may be used instead. Examples of the techniques are as follows: The image on the recording medium may be irradiated with infrared rays or rays emitted from a halogen lamp or a xenon flash lamp, or hot air is blown onto the image on the recording medium.

In a case where a coated sheet or a laminated sheet is used for the recording medium P in heat fixing, moisture that is contained in the paper rapidly evaporates with sharp increase of temperature. As a result, a phenomenon called "blister", by which a surface of the paper becomes irregular, infrequently occurs. To prevent the blister, it is preferable that fixing devices are arranged, and that electric power fed to the fixing devices is changed and/or distances from the fixing devices to the recording medium P are varied so as to secure gradual temperature increase.

It is preferable that the image forming surface of the recording medium P is held so as not to contact anything at least in a process from the image formation by the ink ejected from the recording head unit 80 to the fixing by the fixing/transporting means 76.

The recording medium P, on which the image has been fixed, is discharged onto a not-shown discharged sheet tray while being guided by the guide 78.

Next, an image forming means and an image recording method in the ink jet printer 60 will be described.

As described above, the image forming means of the ink jet printer 60 in this embodiment includes the recording head unit 80 for ejecting ink, the ink circulation system 82 that supplies the ink to the recording head unit 80 and recovers the ink from the recording head unit 80, the head driver 84 that drives the recording head unit 80 in accordance with an output image signal from a not-shown external device such as a computer or a raster image processor (RIP), the recording medium position detection means 86 for detecting the recording medium P in order to determine an image formation (recording) position on the recording medium P, and the recording position control means 88 for controlling the position of the recording head unit 80.

The recording head unit 80 includes recording heads for four colors of cyan (C), magenta (M), yellow (Y), and black (K) for recording a full-color image, and forms (records) an image on the recording medium P transported by the transport belt 68 at a predetermined speed by ejecting ink supplied by the ink circulation system 82 as ink droplets in accordance with signals from the head driver 84. The recording heads for the respective colors are arranged along a traveling direction of the transport belt 68.

As the recording head unit 80, a multi-channel head is used in which multiple nozzles (each nozzle corresponds to one unit of the ejection head that ejects ink droplets) are arranged at predetermined intervals in a direction (widthwise direction) orthogonal to the transport direction of the recording medium P.

The ink jet printer 60 of the illustrated case performs main scanning by transporting the recording medium P with respect to the recording head unit 80 using the transport belt 68. With this construction, the ink jet printer 60 of the illustrated case becomes capable of performing image formation at a higher speed as compared with a case of an ink jet printer that serially scans its recording head. However, this is not the sole case of the present invention.

When the multi-channel head is used for the recording head unit 80, the main scanning is performed by transporting the recording medium P with respect to the recording head unit 80 through rotation of the transport belt 68 under a state where the recording medium P is held on the transport belt 68. Also, sub scanning is performed by moving the recording head unit 80 in the widthwise direction of the transport belt 68. In this manner, an image is formed on the recording medium P. Consequently, in order to form an image on the entire area of the recording medium P, the transport belt 68 is rotated multiple times while holding the recording medium P, that is, the main scanning is performed multiple times. Note that a sub scanning method of the recording head unit 80 in this case may be selected as appropriate in accordance with the relation between the nozzle density of the recording head unit 80 and drawing resolution, an interlace method, and the like.

After an image is formed on the entire area of the recording medium P by the recording head unit 80 using the multi-channel heads in this manner, the recording medium P is nipped and transported by the fixing/transporting means 76, during which the formed image is fixed by the fixing/transporting means 76.

The ink jet printer 60 described above is arranged such that the entire surface of the recording medium P is scanned by the recording head unit 80 using the multi-channel heads. It is evident that the scanning method is not limited to the above-mentioned scanning method. Any type of the scanning method may be used if the entire surface of the recording medium P can be scanned by the recording head unit 80 while the recording medium P and the recording head unit 80 are relatively moved. For example, the following scanning method is allowed: The recording head unit 80 is moved in the width direction of the transport belt 68 to make the main scan, and the recording medium P is moved by the transport belt 68 to make the sub-scan. Another scanning method allowed is that in a state in which the recording head unit 80 is kept fixed, the transport belt 68 is transported in its longitudinal direction and the transport belt 68 per se is moved in its width direction to make the sub-scan.

The ink tank which is a characteristic feature of this embodiment will be described.

Figure 1:
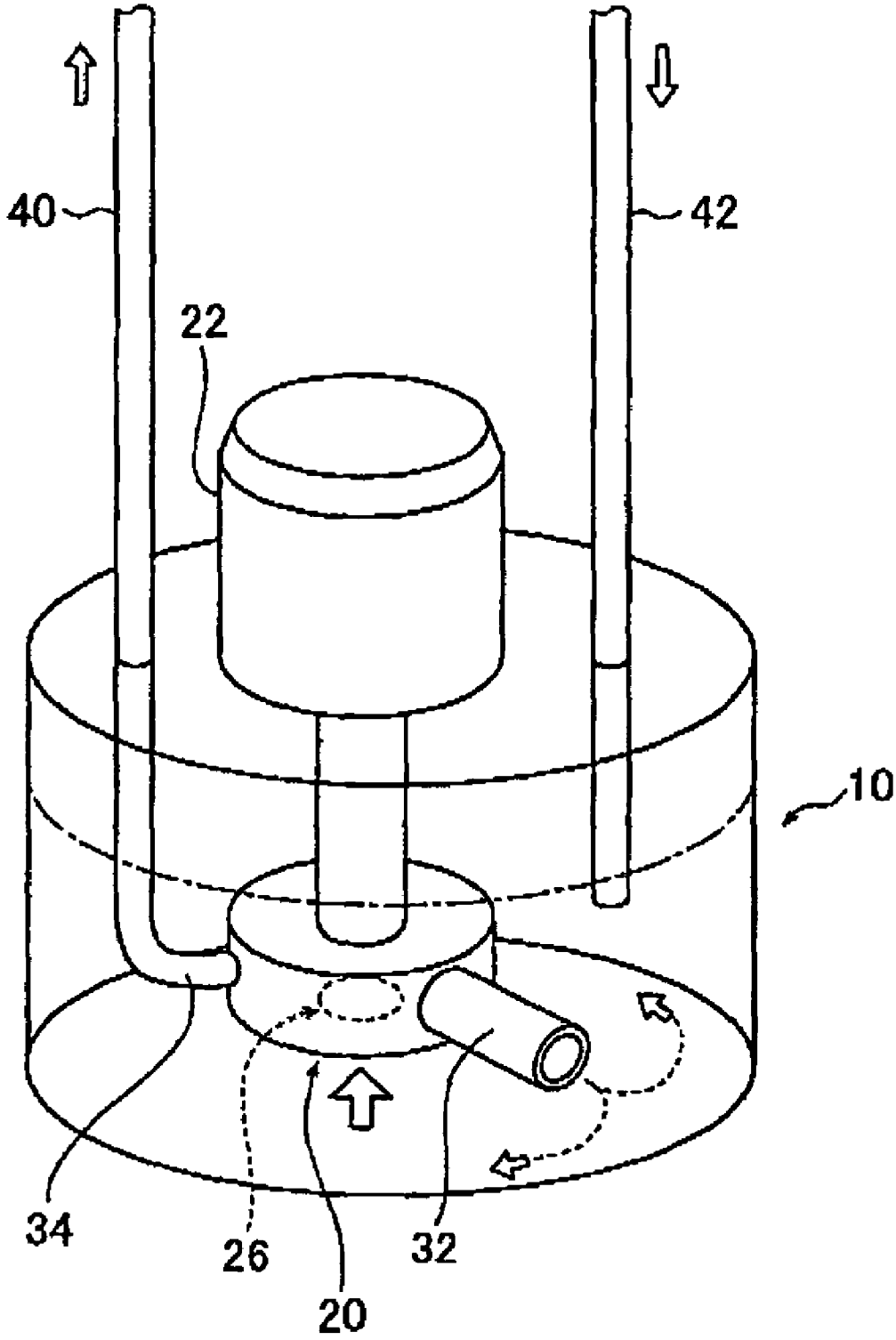
FIG. 1 is a perspective view showing a structure of a major portion of an ink tank according to an embodiment of the present invention.
Figure 2:
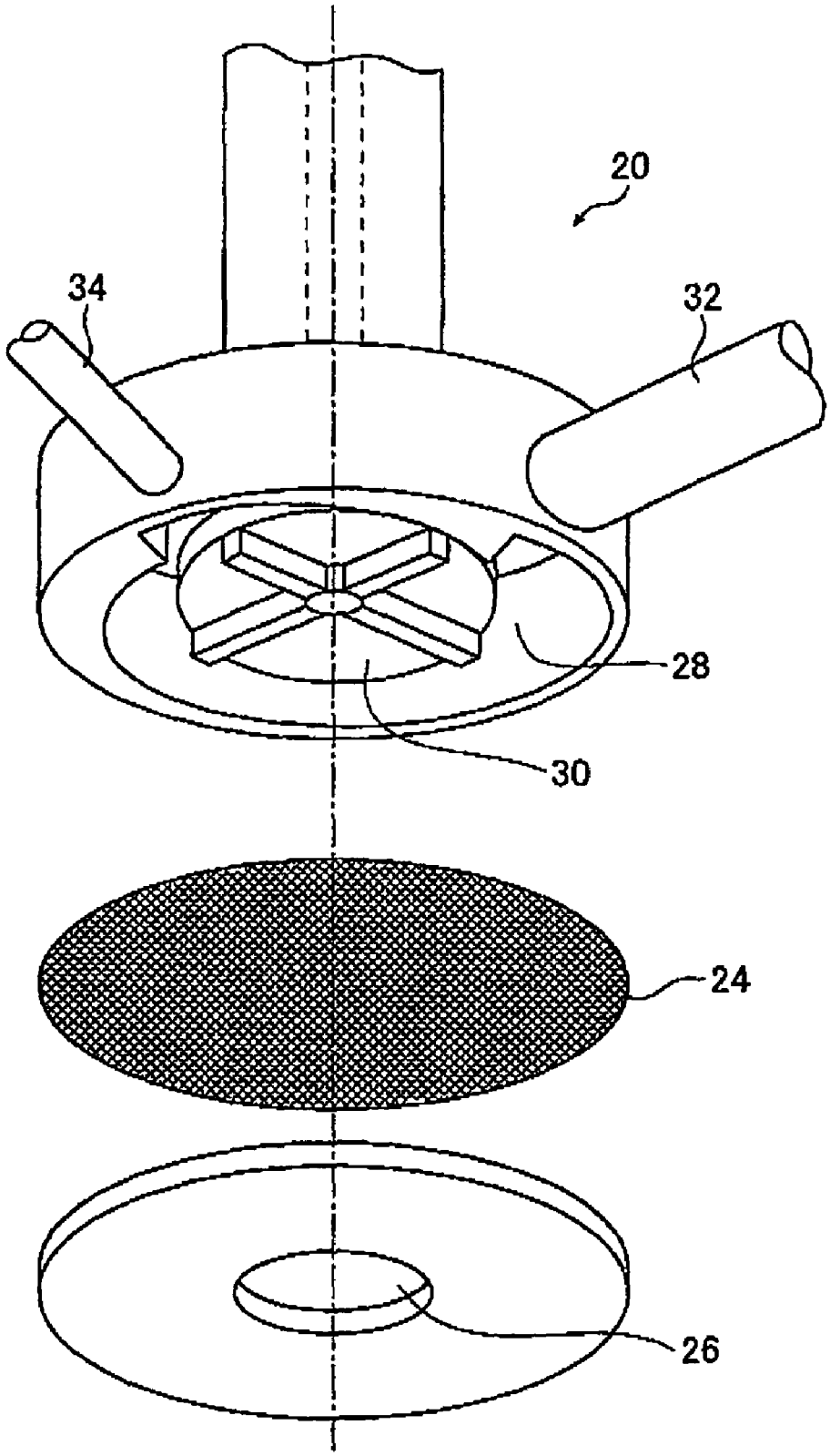
FIG. 2 is an exploded perspective view showing a pump shown in FIG. 1 when viewed upward from the lower side.

FIG. 1 is a perspective view showing a structure of a major portion of an ink tank according to this embodiment. In FIG. 1, reference numeral 10 is an ink tank, and numeral 20 is a pump. FIG. 2 is an exploded perspective view showing a pump 20 shown in FIG. 1 when viewed upward from the lower side.

The ink tank 10 is disposed for each color within an ink circulating device 82*a* to be described later.

The ink tank 10 is basically a tank having a water-tight structure. A drive shaft part extends from a motor 22 of the pump 20 into the tank 10. An ink supplying passage (pipe) 40 for supplying ink to the recording head unit (not shown in FIG. 1), and an ink recovering passage (pipe) 42 for recovering ink from the recording head unit, are also provided in the ink tank 10. A drain pipe with a valve (not shown) is provided on the bottom surface.

The pump 20 is a centrifugal pump and is immersed in ink contained in the ink tank 10. A suction port 26 for sucking ink through a filter 24 is formed in the bottom surface of the pump 20. An impeller 30 mounted on the drive shaft extended from the motor 22 is provided in a pump chamber 28. A first discharge port (also referred to as a first discharge tube in view of its shape) 32 for stirring ink within the ink tank and a second discharge port (also referred to as a second discharge tube) 34 for feeding ink to an ink supplying system connected to the recording head unit are disposed on the periphery of the pump chamber 28. A wire gauze of a 1–40 μm mesh is preferably used for the filter 24.

When operated in the ink tank 10, the pump 20 sucks ink from the suction port 26 through the filter 24, and discharges the sucked ink through the first and second discharge tubes 32 and 34. As described above, the ink discharged from the second discharge tube 34 is fed to the recording head by way of an ink supplying passage 40. As for the ink discharged from the first discharge tube 32, it is stirred in the ink tank 10. Accordingly, ink particles in the ink do not flocculate or sediment, and consistent dispersion of the ink particles is kept.

Thus, the pump 20 provided in the ink tank 10 according to this embodiment is immersed in the ink contained in the ink tank 10 and includes the second discharge tube 34 having a discharge pressure high enough to supply the ink to the recording head at a predetermined flow rate, and the first discharge tube 32 having a sufficient stirring capability to consistently maintain the dispersion of the ink particles in the ink tank 10. The ratio between the first discharge flow from the first discharge tube 32 and the second discharge flow from the second discharge tube 34 is preferably 50:1 or more. It is preferable that the pump 20 has no sliding portion, does not cause flocculation due to the friction between the ink and the pump and can hence effectively prevent the flocculation of the ink particles.

Such a multi-function can be realized by using the centrifugal pump as the pump serving as a basic component, and by employing a unique structure for the discharge port. One of the approaches is that a diameter ratio between the first discharge tube 32 and the second discharge tube 34 shown in FIGS. 1 and 2 is defined. In this case, the diameter ratio must be determined so as to produce a predetermined discharge pressure under an actual load.

To efficiently stir the ink in the ink tank 10, in particular to stir the ink by circulating a large amount of ink, the flow velocity as well as the flow rate is an important factor. That is, where the flow rates are equal but the flow velocities are different, the stirring effects (specifically, the amount of aggregation or sedimentation of the ink particles) are different.

Any of ink discharging tubes having various shapes as shown in FIGS. 3A to 5 may be used for the pump 20 in the ink tank 10 according to this embodiment.

Figure 3A:
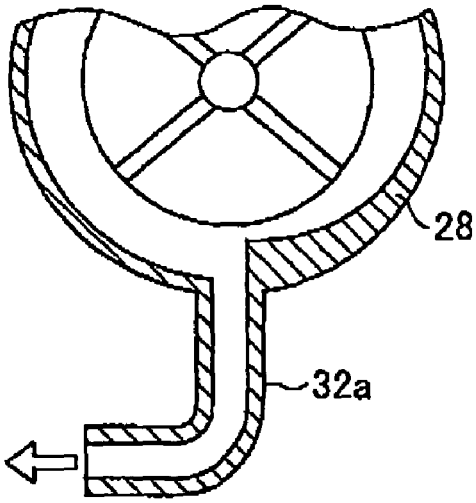
FIGS. 3A and 3B are cross sectional views each showing a specific construction of an ink discharge tube.
Figure 3B:
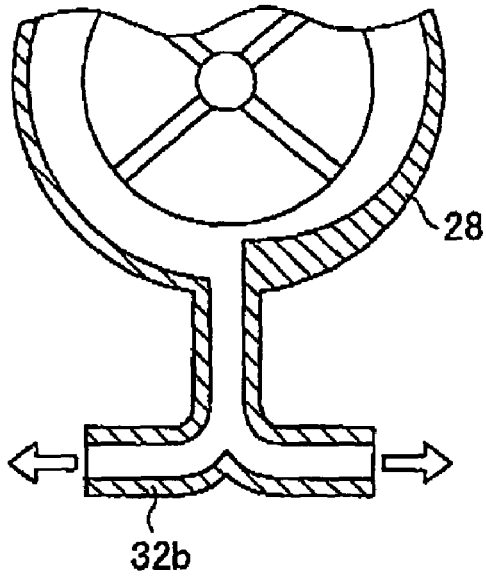

For example, an ink discharge tube 32*a* shown in FIG. 3A is a modification of the first discharge tube 32*a* shown in FIG. 2. The tip end of the first discharge tube 32*a* is bent to a specified direction to facilitate the setting of the ink discharging direction at a preferable direction (in which the stirring effect is enhanced) in connection with a shape of a wall surface of the ink tank 10, for example. An ink discharge tube 32*b* shown in FIG. 3B has a bifurcate shape and is a modification of the ink discharge tube 32*a* shown in FIG. 3A. Two tip ends of the branched ink discharge tube 32*b* extend in specified two directions. Also in this case, the ink discharging direction can be easily set at preferable two directions (in which the stirring effect is enhanced) in connection with a shape of the wall surface of the ink tank 10.

Figure 4A:
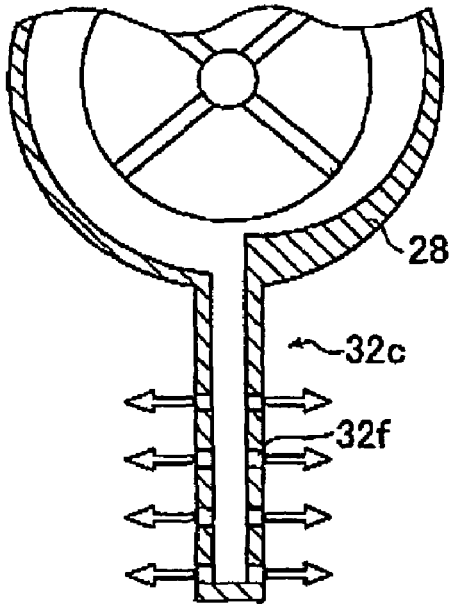
FIG. 4A is a cross sectional view showing another specific construction of the ink discharge tube.

An ink discharge tube 32*c* shown in FIG. 4A extends straight as the first discharge tube 32 shown in FIG. 2, and an end of the straight ink discharge tube 32*c* is closed and a large number of ink discharge holes 32*f* are formed in both side walls of the ink discharge tube 32*c*. Also in the thus constructed ink discharge tube, the ink discharging direction can be easily set at a preferable direction (in which the stirring effect is enhanced) in connection with a shape of the wall surface of the ink tank 10.

Figure 4B:
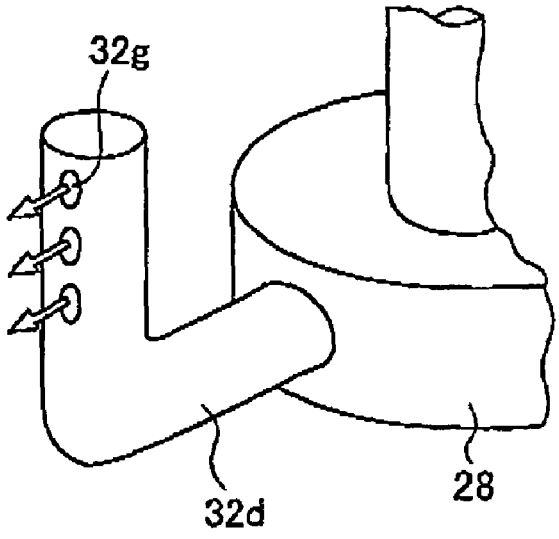
FIG. 4B is a perspective view of the ink discharge tube shown in FIG. 4A.

An ink discharge tube 32*d* shown in FIG. 4B is a modification of the ink discharge tube 32*c* shown in FIG. 4A and extends in a vertical direction. An end of the raised portion of the ink discharge tube 32*d* is closed, and a large number of ink discharging holes 32*g* are formed in a side wall of the raised portion of the tube. Also in the thus constructed ink discharge tube, an ink discharging direction can be easily set to be a preferable direction (in which the stirring effect is enhanced) in connection with a shape of the wall surface of the ink tank 10.

Figure 5:
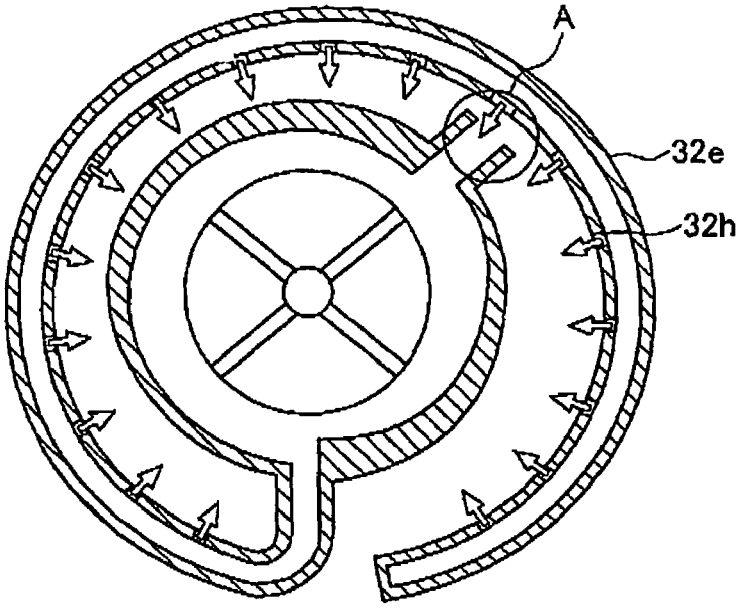
FIG. 5 is a cross sectional view showing still another specific construction of the ink discharge tube.

FIG. 5 shows an ink discharge tube 32*e* according to another embodiment of the invention. The ink discharge tube 32*e* shown in FIG. 5 has a circular shape on a plane. A large number of ink discharging holes 32*h* through which ink is ejected from the ink discharge tube 32*e* toward the inside of the ink tank 10 are formed in the ink discharge tube 32*e*. A circle A in FIG. 5 indicates a position where the second discharge port 34 is located.

In the thus constructed ink discharge tube, an ink discharging direction can be easily set to be a preferable direction (in which the stirring effect is enhanced) while being little affected by the shape of the wall surface of the ink tank 10. Ink is discharged in a horizontal direction from all of the ink discharge tubes 32, 32*a*, 32*b*, 32*c*, 32*d* and 32*e*.

Returning to FIG. 6, description will be continued about other portions of the ink jet printer.

Next, the ink circulation system 82 is used to have ink whose amount is sufficient for ink ejection, flow through ink flow path of the recording head for each color of the recording head unit 80, and the ink tank 10 and the pump 20 shown in FIGS. 1–5 are applied to the ink circulation system 82 at least for one color, preferably for each color. The ink circulation system 82 includes an ink circulation device 82*a* including the ink tank 10 (see FIG. 1), the pump 20 (see FIG. 1), a replenishing ink tank (see FIG. 7), and the like for each of four colors (C, M, Y, and K). The ink circulation system 82 also includes an ink supplying system 82*b* (including the ink supplying passage 40 (see FIG. 1) for each color) that supplies the ink in each color from the ink tank 10 (see FIG. 1) for each color in the ink circulation device 82*a* to each ink flow path for each color in the recording head unit 80. The ink circulation system 82 further includes an ink recovery system 82*c* (including the ink recovering passage 42 (see FIG. 1) for each color) that recovers the ink from the ink flow path for each color in the recording head unit 80 to the ink circulation device 82*a*.

The ink circulation system 82 is not specifically limited so long as it is possible to circulate the ink by supplying the ink in each color from the ink tank 10 (see FIG. 1) for each color in the ink circulation device 82*a* to the recording head unit 80 through the ink supplying system 82*b* and recovering the ink in each color from the recording head unit 80 to the ink tank 10 through the ink recovery system 82*c*. The ink tank 10 reserves the ink in each color for image recording, with the reserved ink being pumped up by the pump and supplied to the recording head unit 80. In the electrostatic ink jet recording system, ink having been concentrated is ejected from the recording head unit 80. Therefore, the concentration of the ink circulated by the ink circulation system 82 is lowered as a whole. Then, it is preferable that the ink circulation system 82 is constructed so that the ink concentration is detected using an ink concentration detector and the ink is supplied as appropriate from the replenishing ink tank in accordance with the detected ink concentration. With this construction, it becomes possible to maintain the ink concentration in a predetermined range. The ink circulation system 82 is more preferably provided with detection means for detecting ink physical properties other than the ink concentration.

Also, it is preferable that the ink tanks are each provided with an ink temperature controller for suppressing changes in temperature of the ink. This is because if the temperature control is not performed, the ink temperature changes due to changes in environmental temperature or the like and therefore there occur changes in physical properties of the ink and in size of dots, so that it may become impossible to form high-quality images in a consistent manner. Besides, a stirring device for suppressing sedimentation/aggregation of a solid component of the ink can be subsidiary provided with the ink tank. As the subsidiary stirring device, it is possible to use a rotary blade, an ultrasonic transducer, a circulation pump, or the like.

As the ink temperature control method, it is possible to use various known methods such as a method with which a heat generation element or a cooling element, such as a heater or a Peltier element, is provided for the recording head unit 80, the ink tank 10 (see FIG. 1), the ink supplying system 82*b*, the ink recovery system 82*c*, or the like and the ink temperature is controlled using various types of temperature sensors such as a thermostat.

Figure 7:
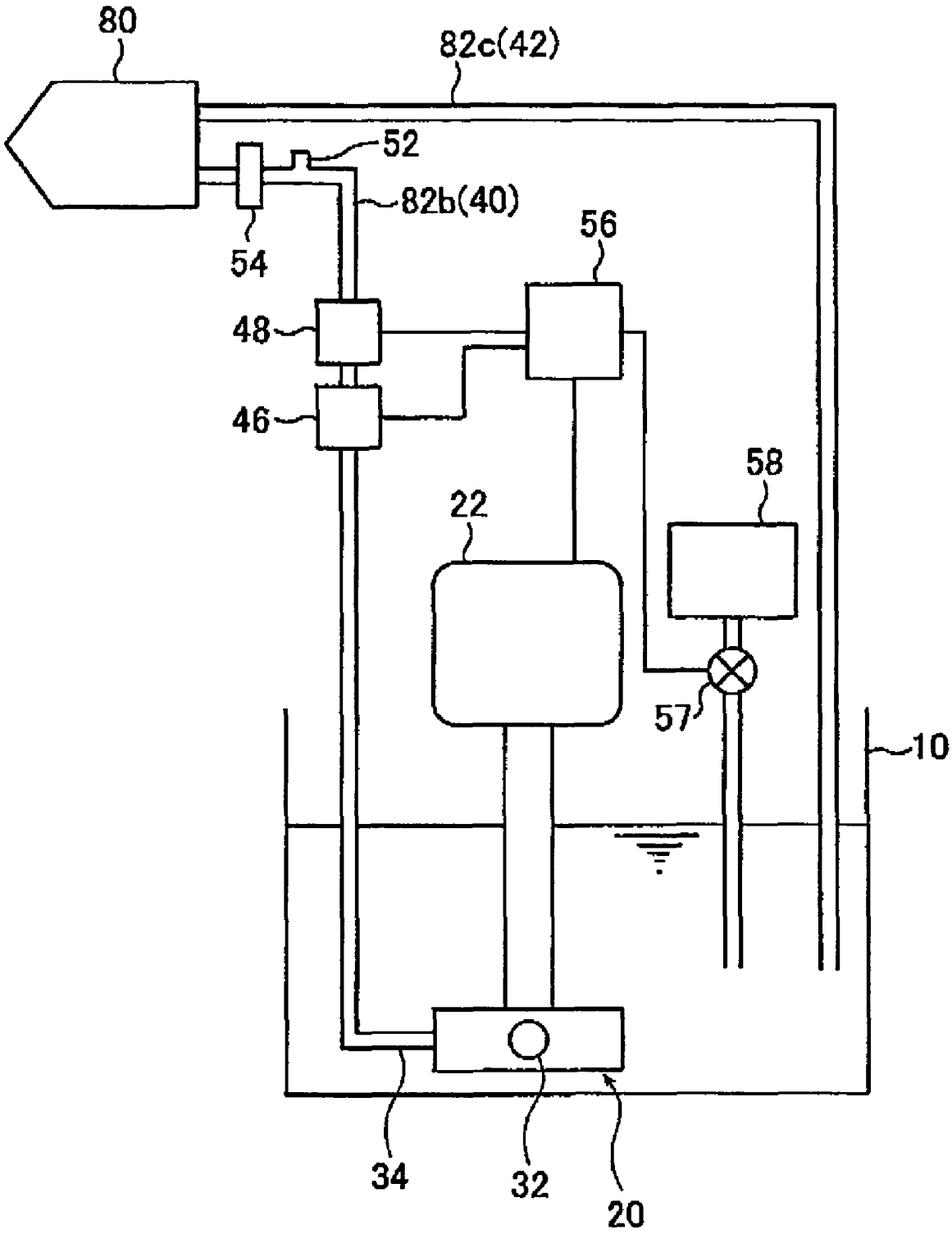
FIG. 7 is a schematic view showing the outline of an ink circulation system for one color.

For example, as schematically shown in FIG. 7, the ink supplying system 82*b* which includes the ink supplying passage 40 connected to the second discharge tube 34 of the pump 20 can be provided with an ink physical properties detecting device 46 including the ink concentration detector, an ink temperature regulating (controlling) device 48 for regulating the ink temperature, and air bubble removal means such as an air trap 52 and a filter 54 for removing air bubbles in ink. The air bubble removal means including the air trap 52 is used to remove air bubbles which sometimes enter the ink supplying system 82*b* from the pump 20 or the like and remain in a corner formed in the system 82*b* where the passage is bent, and is preferably provided in the vicinity of the corner, more preferably on the downstream side thereof.

The ink physical properties detecting device 46 and the ink temperature regulating device 48 may be provided anywhere in the ink tank 10 or the ink circulation system 82. Unlike the configuration in the illustrated case, these devices 46, 48 may be provided for example in the first discharge port 32 or the second discharge port 34 of the pump 20. Alternatively, the devices 46, 48 may be provided in another ink circulation system which is connected to another discharge port separately formed in the pump 20.

The results of the ink physical properties including ink concentration as detected by the ink physical properties detecting device 46, and the results of the ink temperature as detected by the ink temperature regulating device 48 are preferably sent to a controller 56 and used to control the motor 22 for driving the pump 20, a replenishing solenoid valve 57 for adjusting the amount of ink to be supplied from a replenishing ink tank 58 such as a concentrated ink tank or a diluted ink tank to the ink tank 10 for replenishment, and the like.

The head driver 84 shown in FIG. 6 receives image data from a system control portion (not shown) that receives image data from an external device and performs various processing on the image data, and drives the recording head unit 80 based on the image data. The system control portion color-separates the image data received from the external device such as a computer, an RIP, an image scanner, a magnetic disk device, or an image data transmission device. The system control portion then performs division computation into an appropriate number of pixels and an appropriate number of gradations, performs screening processing, performs computation of a halftone dot area ratio on the color-separated data. The head driver 84 is a portion where the head drive data is computed for driving the recording head unit 80.

Also, the system control portion controls movement of the recording head unit 80 (recording position control means 88) and timings of ink ejection by the recording head unit 80 in accordance with transport timings of the recording medium P by the transport belt 68. The ink ejection timings are controlled using an output from the recording position control means 88 or an output signal from an encoder arranged for the transport belt 68 or a drive means of the transport belt 68.

The recording medium position detection means 86 detects the recording medium P transported to a position at which the recording head unit 80 ejects ink droplets, and may be any known detection means such as a photosensor.

The recording position control means 88, on which the recording head unit 80 is mounted/fixed, moves the recording head unit 80 in the widthwise direction of the transport belt 68 and adjusts an image forming position on the recording medium P in the widthwise direction. That is, in order to perform fine adjustment for image formation at a predetermined position on the recording medium P and to perform sub scanning when the multi-channel head is used as the recording head unit 80, the recording position control means 88 moves the recording head unit 80 in accordance with the position of the transport belt 68 detected by the transport belt position detection means 69 and an image signal from the head driver 84.

In the illustrated ink jet printer 60, the discharge fan 90 and the solvent collecting device 92 are provided as the solvent collecting means. Those devices are used to collect dispersed solvent evaporated from the ink droplets ejected onto the recording medium P, and are not directly relevant to the present invention. Hence, no further description thereof will be given here.

As seen from the foregoing description, the present invention successfully provides an ink jet recording apparatus, which is simple in construction, prevents the aggregation and sedimentation of ink particles, and consistently maintains the dispersion of ink particles.

While the invention has been described by reference to specific embodiments, it should be understood that the invention is not limited to those embodiments, but may be variously modified and improved within the scope and spirit of the invention.

For example, the ink discharge tubes shown in FIGS. 3A to 5 may be appropriately combined in use.

The centrifugal pump having no sliding part as stated above is preferable for the pump used in the ink tank of the ink jet recording apparatus of the invention. If such a requirement is satisfied, any other type of pump may be used.

What is claimed is:

1. An ink jet recording device, comprising:

an ink jet recording head; and an ink circulation system which circulates ink by supplying said ink to said ink jet recording head and recovering said ink supplied to said recording head, wherein said ink circulation system comprises:

an ink tank which stores said ink;

ink feeding means for supplying said ink to said ink jet recording head;

an ink supplying system through which said ink is supplied from said ink tank to said ink jet recording head by said ink feeding means; and an ink recovery system through which said ink is recovered from said ink jet recording head to said ink tank, and wherein said ink feeding means is provided in said ink tank, and has both a function to supply said ink from said ink tank to said ink jet recording head and a function to stir said ink stored in said ink tank, wherein said ink feeding means comprises a no-sliding type pump having no sliding part and comprising at least one ink suction port immersed in said ink tank and at least two ink discharge ports immersed in said ink tank, and wherein at least one ink discharge port of said at least two ink discharge ports communicates with said ink supplying system to achieve the function to supply said ink to said ink jet recording head and at least one ink discharge port of the other is opening to said ink in said ink tank to achieve the function to stir said ink stored in said ink tank.

2. The ink jet recording device according to claim 1, wherein said ink is obtained by dispersing at least colored particles in a solvent.

3. The ink jet recording device according to claim 1, wherein said no-sliding type pump is a centrifugal pump.

4. The ink jet recording device according to claim 1, wherein a filter is provided in said at least one ink suction port.

5. The ink jet recording device according to claim 1, wherein said ink circulation system further comprises bubble removal means for removing one or more bubbles, provided in an ink passage connected to at least one ink discharge port of said at least two ink discharge ports.

6. The ink jet recording device according to claim 1, wherein said ink circulation system further comprises ink physical property detecting means for detecting one or more physical properties of said ink, provided in an ink passage connected to at least one ink discharge port of said at least two ink discharge ports.

7. The ink jet recording device according to claim 6, wherein said ink physical property detecting means is an ink concentration detector for detecting an ink concentration of said ink in said ink passage.

8. The ink jet recording device according to claim 1, wherein said ink circulation system further comprises ink temperature regulating means for regulating ink temperature of said ink, provided in an ink passage connected to at least one ink discharge port of said at least two ink discharge ports.

9. The ink jet recording device according to claim 1, wherein said ink circulation system further comprises bubble removal means for removing one or more bubbles, provided in an ink passage.

10. The ink jet recording device according to claim 9, wherein said ink passage in which said bubble removal means is provided is said ink supplying system through which said ink is supplied from said ink tank to said ink jet recording head.

11. The ink jet recording device according to claim 1, wherein said ink circulation system further comprises ink physical property detecting means for detecting one or more physical properties of said ink, provided in an ink passage.

12. The ink jet recording device according to claim 1, wherein said ink circulation system further comprises ink temperature regulating means for regulating ink temperature of said ink.

13. The ink jet recording device according to claim 12, wherein said ink temperature regulating means is provided in at least one of said ink jet recording head, said ink tank, said ink supplying system and said ink recovery system.

14. The ink jet recording device according to claim 1, wherein said at least one ink discharge port opening to said ink in said ink tank is bent to a specified direction to enhance a stirring effect.

15. The ink jet recording device according to claim 1, wherein said at least one ink discharge port opening to said ink in said ink tank has a bifurcated shape to discharge the ink in two directions to enhance a stirring effect.

16. The ink jet recording device according to claim 1, wherein said at least one ink discharge port opening to said ink in said ink tank comprises a closed end and side walls on which a plurality of ink discharge holes formed, and wherein the ink is discharged through the plurality of the ink discharge holes to enhance a stirring effect.

17. The ink jet recording device according to claim 16, wherein said at least one ink discharge port opening to said ink in said ink tank has a circular shape, and wherein the ink discharged through the plurality of the ink discharge holes is directed toward inside of the ink tank.

18. The ink jet recording device according to claim 1, wherein an ink discharge flow rate in the other at least one ink discharge port opening to said ink in said ink tank is greater than an ink discharge flow rate in said at least one ink discharge port communicating with said ink supplying system.

19. An ink jet recording device, comprising:

an ink jet recording head; and an ink circulation system which circulates ink by supplying said ink to said ink jet recording head and recovers said ink supplied to said recording head, wherein said ink circulation system comprises:

an ink tank which stores said ink;

ink feeding means for supplying said ink to said ink jet recording head;

an ink supplying system through which said ink is supplied from said ink tank to said ink jet recording head by said ink feeding means; and an ink recovery system through which said ink is recovered from said ink jet recording head to said ink tank, wherein said ink feeding means is provided in said ink tank, and has both a function to supply said ink from said ink tank to said ink jet recording head and a function to stir said ink stored in said ink tank, wherein said ink feeding means comprises a no-sliding type pump having no sliding part and comprising at least one ink suction port immersed in said ink tank and at least two ink discharge ports immersed in said ink tank, wherein at least one ink discharge port of said at least two ink discharge ports communicates with said ink supplying system, and another at least one ink discharge port of said at least two ink discharge ports opens to said ink in said ink tank, and wherein an ink discharge flow rate in the other at least one ink discharge port which opens to said ink in said ink tank is greater than an ink discharge flow rate in said at least one ink discharge port communicating with said ink supplying system.

* * * * *